US008783769B2

(12) United States Patent
Gilbert et al.

(10) Patent No.: US 8,783,769 B2
(45) **Date of Patent: *Jul. 22, 2014**

(54) ELECTROMAGNETIC CHILDREN'S BOUNCER

(71) Applicant: Kids II, Inc., Atlanta, GA (US)

(72) Inventors: David Gilbert, Cumming, GA (US); Peter D Jackson, Alpharetta, GA (US); Alex E Soriano, Atlanta, GA (US); Jing Ru Chen, Foshan (CN)

(73) Assignee: Kids II, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,999

(22) Filed: Jan. 28, 2013

(65) Prior Publication Data

US 2013/0134752 A1 May 30, 2013

Related U.S. Application Data

(63) Continuation of application No. 12/614,703, filed on Nov. 9, 2009, now Pat. No. 8,382,203.

(60) Provisional application No. 61/112,837, filed on Nov. 10, 2008.

(51) Int. Cl.
*A47D 13/00* (2006.01)

(52) U.S. Cl.
USPC ..... 297/260.2; 297/217.3; 297/DIG. 11

(58) Field of Classification Search
USPC ..... 297/217.3, 250.1, 260.2, 344.1, DIG. 11
See application file for complete search history.

(56) References Cited

U.S. PATENT DOCUMENTS

| | | | | | |
|---|---|---|---|---|---|
| 3,842,450 | A | * | 10/1974 | Pad | 5/109 |
| 3,849,812 | A | * | 11/1974 | Walsh | 5/108 |
| 4,616,824 | A | * | 10/1986 | Quinlan et al. | 472/119 |
| 4,730,176 | A | | 3/1988 | Matsuo et al. | |
| 4,893,366 | A | | 1/1990 | Rosen | |
| 4,904,926 | A | | 2/1990 | Pasichinskyj | |
| 4,941,453 | A | | 7/1990 | Shakas et al. | |
| 4,945,269 | A | | 7/1990 | Kamm | |
| 5,048,135 | A | * | 9/1991 | Chen | 5/109 |

(Continued)

FOREIGN PATENT DOCUMENTS

| | | | |
|---|---|---|---|
| CN | 1714708 | A | 1/2006 |
| CN | 101365367 | A | 2/2009 |

(Continued)

OTHER PUBLICATIONS

"Brushed DC Electric Motor" from wikipedia.org published Oct. 2007 and retrieved Aug. 28, 2013 via archive.org.*

(Continued)

*Primary Examiner* — Philip Gabler
(74) *Attorney, Agent, or Firm* — Alston & Bird LLP

(57) ABSTRACT

Various embodiments of the present invention are directed to a children's bouncer apparatus. In various embodiments, the apparatus includes a support frame, seat assembly configured to support a child, and bouncer control device. The support frame includes one or more semi-rigid support arms that extend above a base portion and suspend the seat assembly above the base portion. The bouncer control device is configured to impart a driving force on the seat assembly via a magnetic drive assembly, thereby causing the seat assembly to continuously oscillate at the natural frequency of the children's bouncer.

18 Claims, 4 Drawing Sheets

(56) References Cited

U.S. PATENT DOCUMENTS

| | | | | |
|---|---|---|---|---|
| 5,307,531 | A | 5/1994 | Kao | |
| 5,335,163 | A | 8/1994 | Seiersen | |
| 5,394,131 | A | 2/1995 | Lungu | |
| 5,574,339 | A | 11/1996 | Kattwinkel et al. | |
| 5,608,366 | A | 3/1997 | Sako | |
| 5,624,155 | A * | 4/1997 | Bluen et al. | 297/217.3 |
| 5,694,030 | A | 12/1997 | Sato et al. | |
| 6,068,566 | A | 5/2000 | Kim | |
| 6,109,110 | A | 8/2000 | Hwang | |
| 6,246,561 | B1 | 6/2001 | Flynn | |
| 6,362,718 | B1 | 3/2002 | Patrick et al. | |
| 6,378,940 | B1 * | 4/2002 | Longoria et al. | 297/217.3 |
| 6,431,646 | B1 * | 8/2002 | Longoria | 297/217.3 |
| 6,574,806 | B1 * | 6/2003 | Maher | 5/109 |
| 6,580,190 | B2 | 6/2003 | Takasu | |
| 6,692,368 | B1 | 2/2004 | Hyun | |
| 6,710,476 | B2 | 3/2004 | Tanozaki et al. | |
| 6,774,589 | B2 | 8/2004 | Sato et al. | |
| 6,869,368 | B1 | 3/2005 | Clarke et al. | |
| 6,884,226 | B2 * | 4/2005 | Pereira | 601/54 |
| 6,908,398 | B1 * | 6/2005 | Kang | 472/119 |
| 6,916,249 | B2 | 7/2005 | Meade | |
| 7,211,974 | B2 | 5/2007 | Takeuchi | |
| 7,551,100 | B1 | 6/2009 | Salley et al. | |
| 7,607,734 | B2 | 10/2009 | Clapper et al. | |
| 2002/0100116 | A1 | 8/2002 | Richards | |
| 2005/0091744 | A1 * | 5/2005 | Mayyak | 5/109 |
| 2005/0283908 | A1 * | 12/2005 | Wong et al. | 5/109 |
| 2006/0031985 | A1 | 2/2006 | Bloemer et al. | |
| 2007/0205646 | A1 * | 9/2007 | Bapst et al. | 297/261.1 |
| 2008/0098521 | A1 * | 5/2008 | Westerkamp et al. | 5/105 |

FOREIGN PATENT DOCUMENTS

| | | |
|---|---|---|
| DE | 7520683 | 7/1976 |
| EP | 0210816 | 2/1987 |
| JP | 2002-372549 | 12/2002 |
| WO | WO 97/14025 | 4/1997 |
| WO | WO 2007/013770 | 2/2007 |
| WO | WO 2008/025778 | 3/2008 |
| WO | WO 2010/054289 | 5/2010 |

OTHER PUBLICATIONS

International Preliminary Examining Authority, Patent Cooperation Treaty International Preliminary Report on Patentability for International Application No. PCT/US2009/063688, dated Oct. 5, 2010, 16 pages, European Patent Office, The Netherlands.

European Patent Office, Communication Pursuant to Rules 161(1) and 162 EPC for Application No. 09752070.4, dated Jun. 21, 2011, 2 pages, The Netherlands.

European Patent Office, Invitation Pursuant to Article 94(3) and Rule 71(1) EPC for Application No. 09752070.4, dated Mar. 22, 2012, 3 pages, The Netherlands.

European Patent Office, Communication Under Rule 71(3) EPC, Intention to Grant for Application No. 09752070.4, dated Jul. 4, 2012, 31 pages, The Netherlands.

International Search Report and Written Opinion from corresponding International Application No. PCT/US2009/063688 mailed Feb. 15, 2010.

State Intellectual Property Office of People'S Republic of China, First Office Action and Search Report for Application No. 200980147038.9, dated Apr. 3, 2013, 9 pages, China.

Canadian Intellectual Property Office, Requisition by the Examiner in Accordance with Subsection 30(2) of the Patent Rules for Application No. 2,743,120, dated Nov. 9, 2012, 2 pages, Canada.

International Search Report and Written Opinion from corresponding International Application No. PCT/US2011/050875 mailed Nov. 29, 2011.

United States Patent and Trademark Office, Office Action for U.S. Appl. No. 13/228,279, filed Apr. 5, 2013, 14 pages, USA.

United States Patent and Trademark Office, Office Action for U.S. Appl. No. 13/228,279, filed Oct. 21, 2013, 8 pages, USA.

* cited by examiner

ELECTROMAGNETIC CHILDREN'S BOUNCER

CROSS-REFERENCE TO RELATED APPLICATIONS

This patent application is a continuation of U.S. nonprovisional application Ser. No. 12/614,703, filed Nov. 9, 2009, which claims the benefit of U.S. Provisional Application No. 61/112,837, filed Nov. 10, 2008, each of which is herein incorporated by reference in its entirety.

BACKGROUND OF THE INVENTION

Children's bouncers are used to provide a seat for a child that entertains or soothes the child by oscillating upward and downward in a way that mimics a parent or caretaker holding the infant in their arms and bouncing the infant gently. A typical children's bouncer includes a seat portion that is suspended above a support surface (e.g., a floor) by a support frame. The support frame typically includes a base portion configured to rest on the support surface and semi-rigid support arms that extend above the base frame to support the seat portion above the support surface. In these embodiments, an excitation force applied to the seat portion of the children's bouncer frame will cause the bouncer to vertically oscillate at the natural frequency of the bouncer. For example, a parent may provide an excitation force by pushing down on the seat portion of the bouncer, deflecting the support frame, and releasing the seat portion. In this example, the seat portion will bounce at its natural frequency with steadily decreasing amplitude until the bouncer comes to rest. Similarly, the child may provide an excitation force by moving while in the seat portion of the bouncer (e.g., by kicking its feet).

A drawback of the typical bouncer design is that the bouncer will not bounce unless an excitation force is repeatedly provided by a parent or the child. In addition, as the support arms of typical bouncers must be sufficiently rigid to support the seat portion and child, the amplitude of the oscillating motion caused by an excitation force will decrease to zero relatively quickly. As a result, the parent or child must frequently provide an excitation force in order to maintain the motion of the bouncer. Alternative bouncer designs have attempted to overcome this drawback by using various motors to oscillate a children's seat upward and downward. For example, in one design, a DC motor and mechanical linkage is used to raise a child's seat up and down. In another design, a unit containing a DC motor powering an eccentric mass spinning about a shaft is affixed to a bouncer. The spinning eccentric mass creates a centrifugal force that causes the bouncer to bounce at a frequency soothing to the child.

These designs, however, often generate an undesirable amount of noise, have mechanical components prone to wear and failure, and use power inefficiently. Thus, there remains a need in the art for a children's bouncer that will bounce repeatedly and is self-driven, quiet, durable, and power efficient.

BRIEF SUMMARY OF THE INVENTION

Various embodiments of the present invention are directed to a children's bouncer apparatus that includes a bouncer control device for controlling the generally upward and downward motion of the bouncer. The bouncer control device is configured to sense the natural frequency of the children's bouncer and drive the bouncer at the natural frequency via a magnetic drive assembly. The magnetic drive assembly uses an electromagnet to selectively generate magnetic forces that move a drive component, thereby causing the bouncer to oscillate vertically at the natural frequency of the bouncer and with an amplitude controlled by user input. By using the bouncer control device to automatically drive the bouncer at its natural frequency, various embodiments of the present invention provide a children's bouncer that will smoothly bounce at a substantially constant frequency that is pleasing to the child and does not require a parent or child to frequently excite the bouncer. In addition, the magnetic drive assembly to drive the bouncer at its natural frequency ensures the children's bouncer apparatus is quiet, durable, and power-efficient.

According to various embodiments, the bouncer control device comprises a magnetic drive assembly, bouncer frequency sensor, power supply, and bouncer control circuit. The magnetic drive assembly comprises a first magnetic component, second magnetic component, and drive component. According to certain embodiments in which the second magnetic component is an electromagnet, the first magnetic component may be any magnet or magnetic material configured to create a magnetic force with the second magnetic component. The drive component is configured to impart a motive force on the children's bouncer in response to a magnetic force generated between the first magnetic component and second magnetic component. The power supply is configured to transmit electric current to the second magnetic component in accordance with a control signal generated by the bouncer control circuit. The bouncer frequency sensor is a sensor configured to sense the natural frequency of the children's bouncer and generate a frequency signal representative of the natural frequency, allowing the bouncer control device to sense changes in the natural frequency of the bouncer that can occur due to the position and weight of a child. The bouncer control circuit is an integrated circuit configured to receive a frequency signal from the bouncer frequency sensor and generate a control signal configured to cause the power supply to selectively transmit electric current to the second magnetic component. In response to the electric current, the second magnetic component generates a magnetic force causing the magnetic drive assembly to impart a motive force on the children's bouncer that causes the bouncer to bounce at a frequency substantially equal to the natural frequency.

According to various other embodiments, a children's bouncer apparatus is provided comprising a seat assembly, support frame assembly, and bouncer control device. The seat assembly is configured to support a child, while the support frame is configured to semi-rigidly support the seat assembly. A bouncer control device as described above is provided and configured to cause the seat assembly to bounce at a substantially constant frequency. In one embodiment, the bouncer control device is configured to be removably affixed to the seat assembly.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
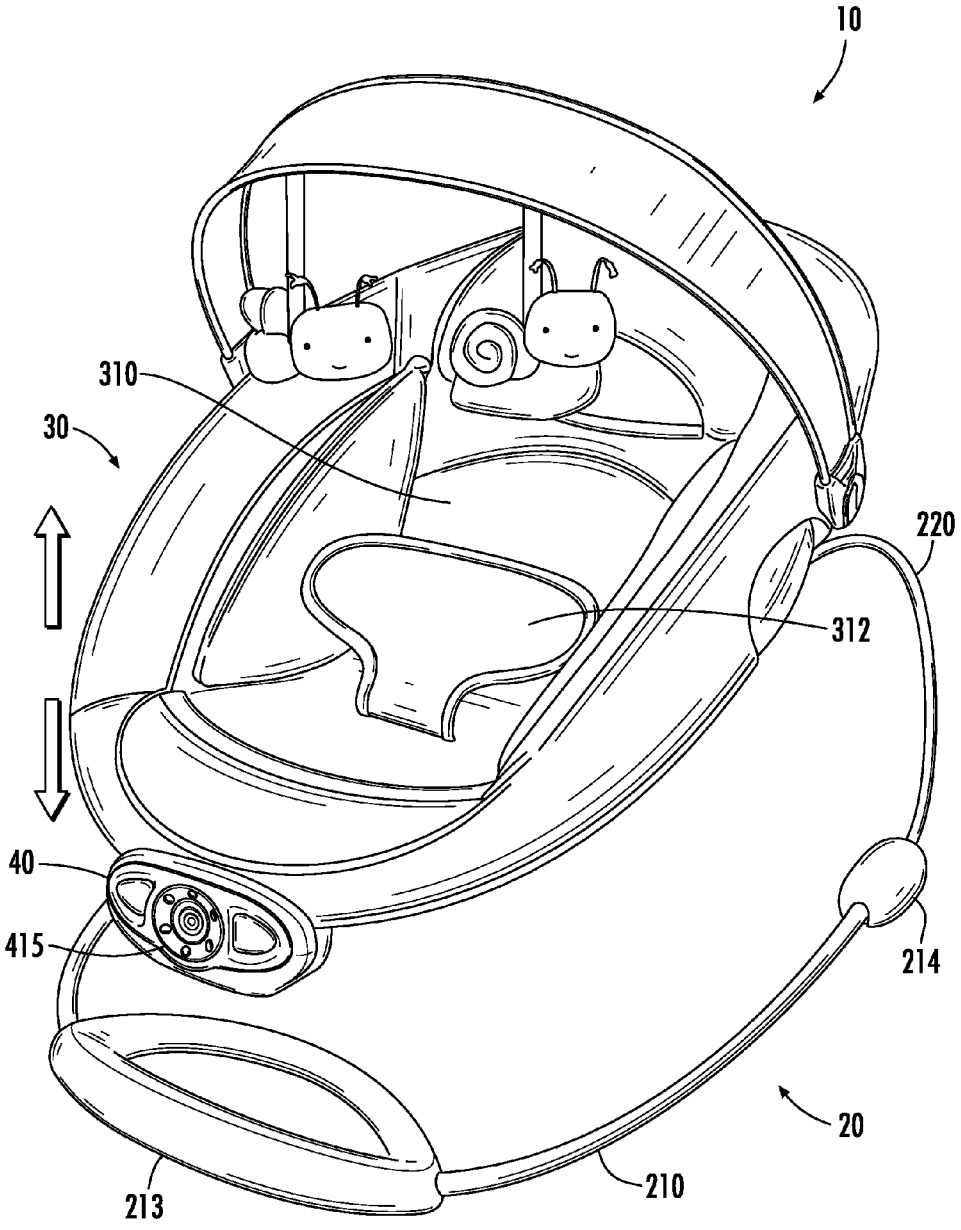
FIG. 1 shows a perspective view of a children's bouncer according to one embodiment of the present invention.

As shown in FIG. 1, various embodiments of the present invention are directed to a children's bouncer apparatus 10 for providing a controllable bouncing seat for a child. The apparatus 10 includes a support frame 20, seat assembly 30, and bouncer control device 40.

Support Frame & Seat Assembly

According to various embodiments, the support frame 20 is a resilient member forming a base portion 210 and one or more support arms 220. In the illustrated embodiment, one or more flat non-skid members 213, 214 are affixed to the base portion 210 of the support frame 20. The flat non-skid members 213, 214 are configured to rest on a support surface and provide a stable platform for the base portion 210. The one or more support arms 220 are arcuately shaped and extend upwardly from the base portion 210. The support arms 220 are configured to support the seat assembly 30 by suspending the seat assembly 30 above the base portion 210. The support arms 220 are semi-rigid and configured to resiliently deflect under loading. Accordingly, the seat assembly 30 will oscillate substantially vertically in response to an exciting force, as shown by the motion arrows in FIG. 1.

In the illustrated embodiment, the seat assembly 30 includes a padded seat portion 310 configured to comfortably support a child. The seat portion 310 further includes a harness 312 configured to be selectively-attached to the seat portion 310 in order to secure a child in the seat portion 310. The seat assembly 30 further includes a control device receiving portion (not shown) configured to receive and selectively secure the bouncer control device 40 to the seat assembly 30. In other embodiments, the bouncer control device 40 is permanently secured to the seat assembly 30.

Bouncer Control Device

Figure 2:
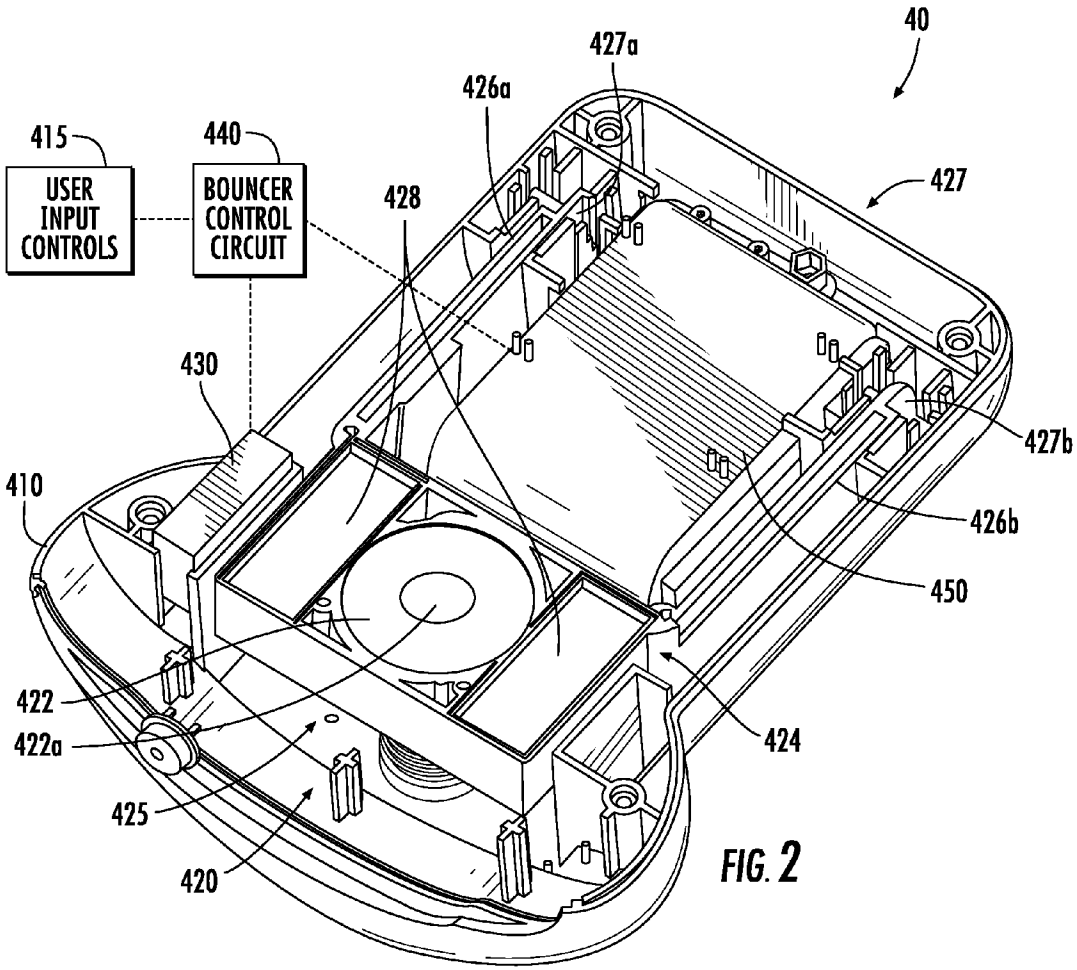
FIG. 2 shows a perspective view of the interior of a bouncer control device according to one embodiment of the present invention.

As shown in FIG. 2, according to various embodiments, the bouncer control device 40 is comprised of a housing 410, user input controls 415, magnetic drive assembly 420, bouncer motion sensor 430, and bouncer control circuit 440. In the illustrated embodiment, the bouncer control device 40 further includes a power supply 450. In other embodiments, the bouncer control device 40 is configured to receive power from an externally located power supply. The housing 410 is comprised of a plurality of walls defining a cavity configured to house the magnetic drive assembly 420, bouncer motion sensor 430, bouncer control circuit 440, and power supply 450. As described above, the housing 410 is configured to be selectively attached to the seat assembly 30. User input controls 415 (shown in more detail in FIG. 1) are affixed to a front wall of the housing 410 and are configured to allow a user to control various aspects of the children's bouncer apparatus (e.g., motion and sound). In the illustrated embodiment, the user input controls 415 include a momentary switch configured to control the amplitude of the seat assembly's 30 oscillatory movement. In FIG. 2, the bouncer control device 40 is shown with the user input controls 415 and an upper portion of the housing 410 removed.

According to various embodiments, the magnetic drive assembly 420 includes a first magnetic component, second magnetic component, and a drive component. The drive component is configured to impart a motive force to the seat assembly 30 in response to a magnetic force between the first magnetic component and second magnetic component. At least one of the first magnetic component and second magnetic component is an electromagnet (e.g., an electromagnetic coil) configured to generate a magnetic force when supplied with electric current. For example, according to embodiments in which the second magnetic component is an electromagnet, the first magnetic component may be any magnet (e.g., a permanent magnet or electromagnet) or magnetic material (e.g., iron) that responds to a magnetic force generated by the second magnetic component. Similarly, according to embodiments in which the first magnetic component is an electromagnet, the second magnetic component may be any magnet or magnetic material that responds to a magnetic force generated by the first magnetic component.

Figure 3:
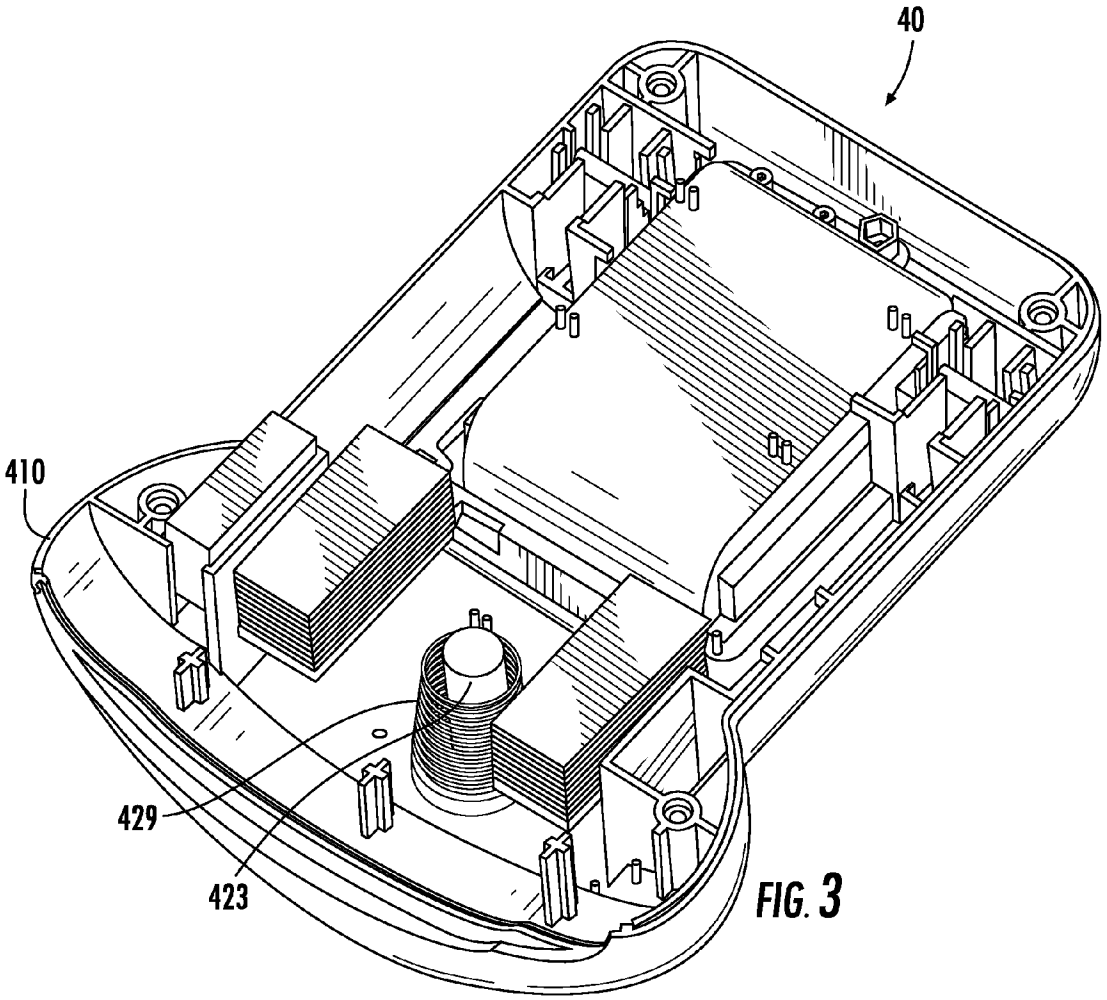
FIG. 3 shows another perspective view of the interior of a bouncer control device according to one embodiment of the present invention.

FIG. 3 shows the interior of the bouncer control device 40 of FIG. 2 with the mobile member 424 and electromagnetic coil 422 removed. In the illustrated embodiment of FIGS. 2 and 3, the first magnetic component comprises a permanent magnet 421 (shown in FIG. 4) formed by three smaller permanent magnets stacked lengthwise within an magnet housing 423. The second magnetic component comprises an electromagnetic coil 422 configured to receive electric current from the power supply 450. The drive component comprises a mobile member 424 and a reciprocating device. The mobile member 424 is a rigid member having a free end 425 and two arms 426*a*, 426*b* that extend to a pivoting end 427. The arms 426*a*, 426*b* are pivotally connected to an interior portion of the housing 410 at pivot points 427*a* and 427*b* respectively. The free end 425 of the mobile member 424 securely supports the electromagnetic coil 422 and can support two weights 428 positioned symmetrically adjacent to the electromagnetic coil 422. As will be described in more detail below, the mobile member 424 is configured to rotate about its pivot points 427*a*, 427*b* in response to a magnetic force generated between the permanent magnet 421 and electromagnetic coil 422.

According to various embodiments, the reciprocating device is configured to provide a force that drives the mobile member 424 in a direction substantially opposite to the direction the magnetic force generated by the permanent magnet 421 and electromagnetic coil 422 drives the mobile member 424. In the illustrated embodiment of FIGS. 2 and 3, the reciprocating device is a spring 429 positioned below the free end 425 of the mobile member 424 and substantially concentric with the electromagnetic coil 422. The magnet housing 423 is arcuately shaped, has a substantially circular cross-section, and is positioned substantially within the spring 429. In addition, the magnet housing 423 is shaped such that it fits within a cavity 422*a* of the electromagnetic coil 422. As is described in more detail below, the magnet housing 423 is positioned such that its cross section is concentric to the electromagnetic coil 422 at all points along the electromagnetic coil's 422 range of motion. In other embodiments, the magnet housing 423 is substantially vertical in shape.

According to various embodiments, the bouncer motion sensor 430 is a sensor configured to sense the frequency at which the seat assembly 30 is vertically oscillating at any given point in time and generate a frequency signal representative of that frequency. According to one embodiment, the bouncer motion sensor 430 comprises a movable component recognized by an optical sensor (e.g., a light interrupter). According to another embodiment, the bouncer motion sensor 430 comprises an accelerometer. As will be appreciated by one of skill in the art, according to various embodiments, the bouncer motion sensor 430 may be any sensor capable of sensing the oscillatory movement of the seat assembly 30 including a Hall effect sensor.

The bouncer control circuit 440 can be an integrated circuit configured to control the magnetic drive assembly 420 by triggering the power supply 450 to transmit electric current pulses to the electromagnetic coil 422 according to a control algorithm (described in more detail below). In the illustrated embodiment, the power supply 450 is comprised of one or more batteries (not shown) and is configured to provide electric current to the electromagnetic coil 422 in accordance with a control signal generated by the bouncer control circuit 440. According to certain embodiments, the one or more batteries may be disposable (e.g., AAA or C sized batteries) or rechargeable (e.g., nickel cadmium or lithium ion batteries). In various other embodiments, the power supply 450 is comprised of a linear AC/DC power supply or other power supply using an external power source.

Figure 4:
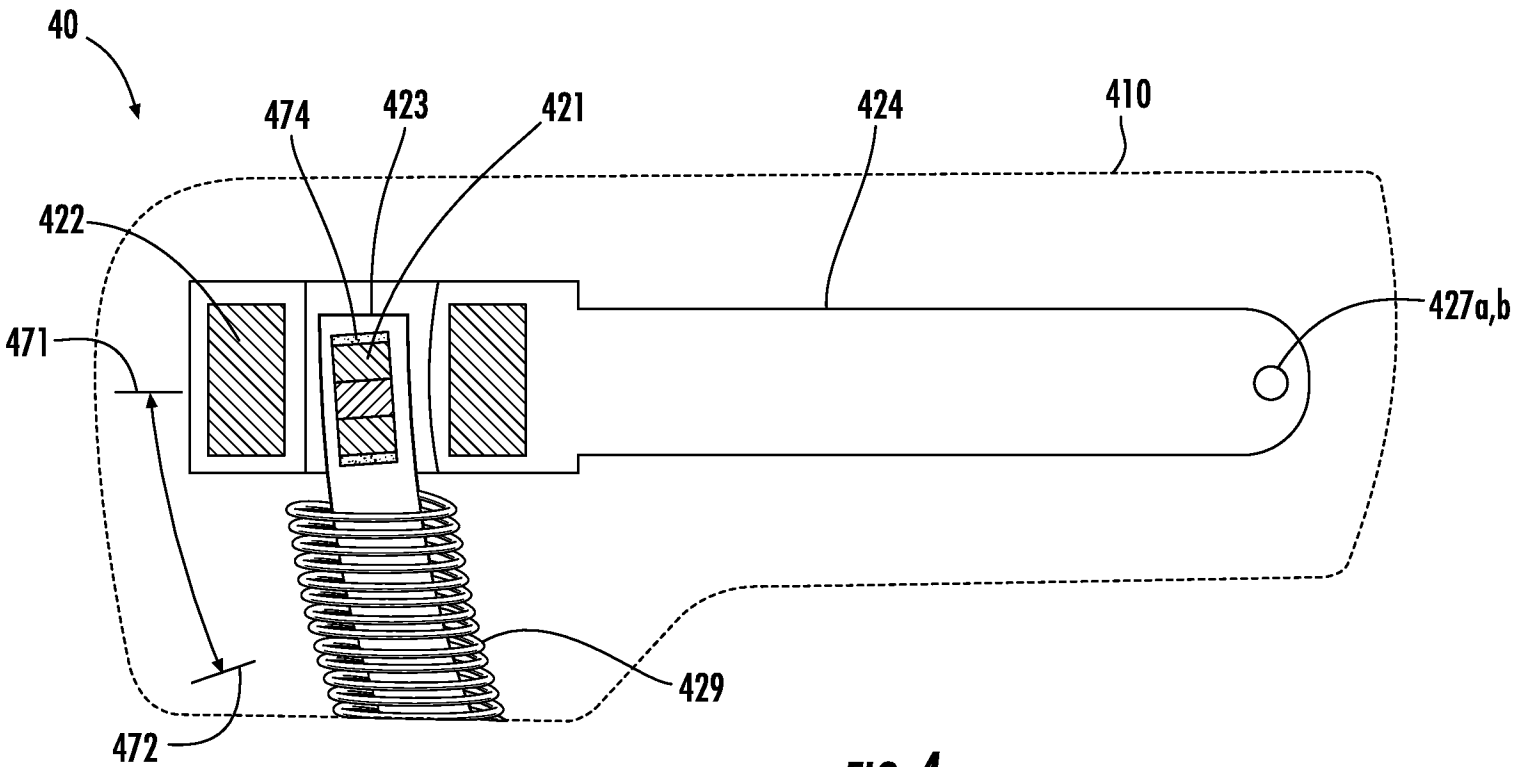
FIG. 4 shows is a schematic sectional view of the interior of a bouncer control device according to one embodiment of the present invention.

FIG. 4 shows a schematic sectional view of one embodiment of the bouncer control device 40. In the illustrated embodiment, the permanent magnet 421 is formed from three individual permanent magnets positioned within the magnet housing 423, although fewer or more individual magnets could be used. Damping pads 474 are positioned at the top and bottom ends of the permanent magnet 421 to hold the permanent magnet 421 securely in place and prevent it from moving within the magnet housing 423 in response to a magnetic force from the electromagnetic coil 422, which might create noise. According to certain embodiments, damping material (not shown) may also be positioned within the housing 410 above the free end 425 of the mobile member 424 to prevent the mobile member 424 from striking the housing 410.

In the illustrated embodiment, the spring 429 extends upwardly from the housing 410 to the bottom edge of the free end of the mobile member 424. As described above, the magnet housing 423 is positioned within the spring 429 and extends upwardly through a portion of the cavity 422*a* (shown in FIG. 2) of the electromagnetic coil 422. As shown in FIG. 4, the mobile member 424 is free to rotate about pivot points 427*a* and 427*b* between an upper position 471 and a lower position 472. As the mobile member 424 rotates between the upper position 471 and lower position 472, the electromagnetic coil 422 follows an arcuate path defined by the length of the mobile member 424. Accordingly, the magnet housing 423 is curved such that, as the mobile member 424 rotates between its upper position 471 and lower position 472, the electromagnetic coil 422 will not contact the magnet housing 423. According to other embodiments, the magnet housing 423 is substantially vertically shaped and dimensioned such that it does not obstruct the path of the mobile member 424.

According to various embodiments, the bouncer control circuit 440 is configured to control the electric current transmitted to the electromagnetic coil 422 by the power supply 450. In the illustrated embodiment, the power supply 450 transmits electric current in a direction that causes the electromagnetic coil 422 to generate a magnetic force that repels the electromagnetic coil 422 away from the permanent magnet 421. When the electromagnetic coil 422 is not supplied with electric current, there is no magnetic force generated between the permanent magnet 421 and electromagnetic coil 422. As a result, as shown in FIG. 4, the mobile member 424 rests at its upper position 471. However, when a magnetic force is generated by supplying electric current to the electromagnetic coil 422, the magnetic force pushes the electromagnetic coil 422 downward and causes the mobile member 424 to rotate toward its lower position 472. This occurs because the permanent magnet 421 is fixed within the stationary magnet housing 423, while the electromagnetic coil 422 is affixed to the mobile member 424. According to other embodiments, the power supply 450 transmits electric current in a direction that causes the electromagnetic coil 422 to generate a magnetic force that attracts the electromagnetic coil 422 toward the permanent magnet 421.

When provided with current having sufficient amperage, the magnetic force generated by the electromagnetic coil 422 will cause the mobile member 424 to compress the spring 429 and, as long as current is supplied to the electromagnetic coil 422, will cause the mobile member 424 to remain in its lower position 472. However, when the power supply 450 stops transmitting electric current to the electromagnetic coil 422, the electromagnetic coil 422 will stop generating the magnetic force holding the mobile member 424 in its lower position 472. As a result, the spring 429 will decompress and push the mobile member 424 upward, thereby rotating it to its upper position 471. Similarly, if a sufficiently strong pulse of electric current is transmitted to the electromagnetic coil 422, the resulting magnetic force will cause the mobile member 424 to travel downward, compressing the spring 429. The angular distance the mobile member 424 rotates and the angular velocity with which it rotates that distance is dependent on the duration and magnitude of the pulse of electric current. When the magnetic force generated by the pulse dissipates, the spring 429 will decompress and push the mobile member 424 back to its upper position 471.

In accordance with the dynamic properties described above, the mobile member 424 will vertically oscillate between its upper position 471 and lower position 472 in response to a series of electric pulses transmitted to the electromagnetic coil 422. In the illustrated embodiment, the frequency and amplitude of the mobile member's 424 oscillatory movement is dictated by the frequency and duration of electric current pulses sent to the electromagnetic coil 422. For example, electrical pulses of long duration will cause the mobile member 424 to oscillate with high amplitude (e.g., rotating downward to its extreme point, the lower position 472), while electrical pulses of short duration will cause the mobile member 424 to oscillate with low amplitude (e.g., rotating downward to a non-extreme point above the lower position 472). Similarly, electrical pulses transmitted at a high frequency will cause the mobile member 424 to oscillate at a high frequency, while electrical pulses transmitted at a low frequency will cause the mobile member 424 to oscillate at a low frequency. As will be described in more detail below, the mobile member's 424 oscillation is controlled in response to the frequency of the support frame 20 and seat assembly 30 as identified by the bouncer motion sensor 430.

According to various embodiments, the bouncer control device 40 is configured to impart a motive force on the seat assembly 30 by causing the mobile member 424 to oscillate within the housing 410. As the bouncer control device 40 is affixed to the seat assembly 30, the momentum generated by the oscillatory movement of the mobile member 424 causes the seat assembly 30 to oscillate along its own substantially vertical path, shown by arrows in FIG. 1. This effect is enhanced by the weights 428 secured to the free end 425 of the mobile member 424, which serve to increase the momentum generated by the movement of the mobile member 424. As will be described in more detail below, by oscillating the mobile member 424 at a controlled frequency and amplitude, the bouncer control device 40 causes the seat assembly 30 to oscillate at a desired frequency and amplitude.

Bouncer Control Circuit

According to various embodiments, the bouncer control circuit 440 comprises an integrated circuit configured to receive signals from one or more user input controls 415 and the bouncer motion sensor 430, and generate control signals to control the motion of the seat assembly 30. In the illustrated embodiment, the control signals generated by the bouncer control circuit 440 control the transmission of electric current from the power supply 450 to the electromagnetic coil 422, thereby controlling the oscillatory motion of the mobile member 424. As described above, high power efficiency is achieved by driving the seat assembly 30 at the natural frequency of the children's bouncer apparatus 10. However, the natural frequency of the children's bouncer apparatus 10 changes depending on, at least, the weight and position of a child in the seat assembly 30. For example, if a relatively heavy child is seated in the seat assembly 30, the children's bouncer apparatus 10 will exhibit a low natural frequency. However, if a relatively light child (e.g., a new-born baby) is seated in the seat assembly 30, the children's bouncer apparatus will exhibit a high natural frequency. Accordingly, the bouncer control circuit 440 is configured to detect the natural frequency of the children's bouncer 10 and cause the mobile member 424 to drive the seat assembly 30 at the detected natural frequency.

According to various embodiments, the bouncer control circuit 440 first receives a signal from one or more of the user input controls 415 indicating a desired amplitude of oscillation for the seat assembly 30. In the illustrated embodiment, the user may select from two amplitude settings (e.g., low and high) via a momentary switch included in the user input controls 415. In another embodiment, the user may select from two or more preset amplitude settings (e.g., low, medium, high) via a dial or other control device included in the user input controls 415. Using an amplitude look-up table and the desired amplitude received via the user input controls 415, the bouncer control circuit 440 determines an appropriate duration D-amp for the electrical pulses that will be sent to the electromagnetic coil 422 to drive the seat assembly 30 at the natural frequency of the children's bouncer apparatus 10. The determined value D-amp is then stored by the bouncer control circuit 440 for use after the bouncer control circuit 440 determines the natural frequency of the bouncer.

According to the illustrated embodiment, to determine the natural frequency of the bouncer, the bouncer control circuit 440 executes a programmed start-up sequence. The start-up sequence begins with the bouncer control circuit 440 generating an initial control signal causing the power supply 450 to transmit an initial electrical pulse of duration D1 to the electromagnetic coil 422, thereby causing the mobile member 424 to rotate downward and excite the seat assembly 30. The magnetic force generated by the electromagnetic coil 422 in response to the initial pulse causes the mobile member 424 to stay in a substantially downward position for a time period substantially equal to D1. As described above, while a continuous supply of electric current is supplied to the electromagnetic coil 422, the mobile member 424 is held stationary at or near its lower position 472 and does not drive the seat assembly 30. Accordingly, during the time period D1, the seat assembly 30 oscillates at its natural frequency.

While the mobile member 424 is held stationary and the seat assembly 30 oscillates at its natural frequency, the bouncer control circuit 440 receives one or more signals from the bouncer motion sensor 430 indicating the frequency of the seat assembly's 30 oscillatory motion and, from those signals, determines the natural frequency of the bouncer apparatus 10. For example, in one embodiment, the bouncer motion sensor 430 sends a signal to the bouncer control device 440 every time the bouncer motion sensor 430 detects that the seat assembly 30 has completed one period of oscillation. The bouncer control circuit 440 then calculates the elapsed time between signals received from the bouncer motion sensor 430 to determine the natural frequency of the bouncer apparatus 10.

If, over the course of the time period D1, the bouncer control circuit 440 does not receive one or more signals from the bouncer motion sensor 430 that are sufficient to determine the natural frequency of the bouncer apparatus 10, the bouncer control circuit 440 causes the power supply 450 to send a second initial pulse to the electromagnetic coil 422 in order to further excite the bouncer apparatus 10. In one embodiment, the second initial pulse may be of a duration D2, where D2 is a time period retrieved from a look-up table and is slightly less than D1. The bouncer control circuit 440 is configured to repeat this start-up sequence until it determines the natural frequency of the bouncer apparatus 10.

After completing the start-up sequence to determine the natural frequency of the children's bouncer apparatus 10, the bouncer control circuit 440 will generate continuous control signals causing the power supply 450 to transmit pulses of electric current having a duration D-amp at a frequency equal to the natural frequency of the children's bouncer apparatus 10. By detecting the oscillatory motion of the seat assembly 30 via the bouncer motion sensor 430, the bouncer control circuit 440 is able to synchronize the motion of the mobile member 424 to the motion of the seat assembly 30, thereby driving the seat assembly's motion in the a power efficient manner. The bouncer control circuit 440 will thereafter cause the bouncer apparatus 10 to bounce continuously at a frequency which is substantially that of the natural frequency of the children's bouncer apparatus 10.

According to various embodiments, as the bouncer control circuit 440 is causing the seat assembly 30 to oscillate at the determined natural frequency, the bouncer control circuit 440 continues to monitor the frequency of the of seat assembly's 30 motion. If the bouncer control circuit 440 detects that the frequency of the seat assembly's 30 motion has changed beyond a certain tolerance, the bouncer control circuit 440 restarts the start-up sequence described above and again determines the natural frequency of the bouncer apparatus 10. By doing so, the bouncer control circuit 440 is able to adapt to changes in the natural frequency of the bouncer apparatus 10 caused by the position or weight of the child in the seat assembly 30.

The embodiments of the present invention described above do not represent the only suitable configurations of the present invention. In particular, other configurations of the bouncer control device 40 may be implemented in the children's bouncer apparatus 10 according to various embodiments. For example, according to certain embodiments, the first magnetic component and second magnetic component are configured to generate an attractive magnetic force. In other embodiments, the first magnetic component and second magnetic component are configured to generate a repulsive magnetic force.

According to various embodiments, the mobile member 424 of the magnetic drive assembly 420 may be configured to rotate upward or downward in response to both an attractive or repulsive magnetic force. In one embodiment the drive component of the magnet drive assembly 420 is configured such that the reciprocating device is positioned above the mobile member 424. Accordingly, in certain embodiments where the magnetic force generated by the first and second magnetic components causes the mobile member 424 to rotate downward, the reciprocating device positioned above the mobile member 424 is a tension spring. In other embodiments, where the magnetic force generated by the first and second magnetic components causes the mobile member 424 to rotate upward, the reciprocating device is a compression spring.

In addition, according to certain embodiments, the first magnetic component and second magnetic components are mounted on the base portion 210 of the support frame 20 and a bottom front edge of the seat assembly 30 or support arms 220. Such embodiments would not require the drive component of the bouncer control device 40, as the magnetic force generated by the magnetic components would act directly on the support frame 20 and seat assembly 30. As will be appreciated by those of skill in the art, the algorithm controlling the bouncer control circuit 440 may be adjusted to accommodate these various embodiments accordingly.

CONCLUSION

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A bouncer control device for controlling the motion of a children's bouncer, the bouncer control device comprising:

a housing configured to be secured to the children's bouncer;

a mobile member operatively connected to the housing and configured to pivot relative to the housing and independently from the children's bouncer;

a first magnetic component operatively connected to the housing;

a second magnetic component operatively connected to the mobile member such that the second magnetic component moves toward and away from the first magnetic component as the mobile member pivots, wherein at least one of the first magnetic component and second magnetic component comprises an electromagnet configured to create a magnetic force with the other of the first and second magnetic components when supplied with electric current;

a power supply configured to transmit electric current to the electromagnet; and a bouncer control circuit configured to generate a control signal that causes the power supply to supply electric current to the electromagnet and thereby generate a magnetic force causing the mobile member to oscillate within the housing.

2. The bouncer control device of claim 1, wherein the second magnetic component comprises the electromagnet.

3. The bouncer control device of claim 1, wherein the first magnetic component comprises one or more permanent magnets.

4. The bouncer control device of claim 1, wherein the mobile member includes a free end and a pivoting end, the pivoting end of the mobile member being pivotally connected to a portion of the housing and the free end of the mobile member being configured to move toward and away from the first magnetic component as the mobile member oscillates; and wherein the second magnetic component is affixed to the free end of the mobile member.

5. The bouncer control device of claim 4, wherein one or more weights are affixed to the free end of the mobile member.

6. The bouncer control device of claim 1, further comprising:

a reciprocating device configured to impart a reciprocating force on the mobile member that drives the mobile member in a direction substantially opposite to the direction in which the magnetic force generated by the first and second magnetic components drives the mobile member.

7. The bouncer control device of claim 6, wherein the reciprocating device comprises one or more springs.

8. The bouncer control device of claim 7, wherein the one or more springs are affixed to the housing and positioned to engage the free end of the mobile member.

9. The bouncer control device of claim 1, wherein the second magnetic component is repelled from the first magnetic component when the electromagnet is energized.

10. The bouncer control device of claim 1, wherein the second magnetic component is attracted to the first magnetic component when the electromagnet is energized.

11. The bouncer control device of claim 1, wherein the housing is configured to be removably affixed to the children's bouncer.

12. The bouncer control device of claim 1, further comprising a bouncer frequency sensor configured to sense the natural frequency of the children's bouncer; and wherein the bouncer control circuit is configured to supply electric current to the electromagnet such that that the mobile member oscillates at the sensed natural frequency.

13. The bouncer control device of claim 1, wherein the bouncer control circuit is further configured to receive user input indicating a desired amplitude of motion for the children's bouncer and, based on the user input, supply electric current to the electromagnet such that the amplitude of the mobile member's oscillation corresponds to the desired bouncer amplitude.

14. A children's bouncer apparatus for providing a controllable bouncing seat for a child, the apparatus comprising:

a seat assembly for supporting a child;

a support frame configured to support the seat assembly, the support frame comprising:

a base portion configured to rest on a support surface;

one or more resilient support arms extending upwardly from the base portion to suspend the seat assembly above the support surface, the one or more support arms being configured to flex in order permit the seat assembly to oscillate in response to a motive force; and a bouncer control device comprising:

a housing secured to at least one of the one or more support arms; and a magnetic drive assembly positioned within the housing and comprising at least one electromagnet and a mobile member configured to oscillate relative to the housing, the electromagnet being configured to generate a magnetic force causing the mobile member to oscillate and thereby impart a motive force that causes the seat assembly to oscillate.

15. The children's bouncer of claim 14, wherein the mobile member is operatively connected to the housing and configured to pivot relative to the housing.

16. The children's bouncer of claim 15, wherein the magnetic drive assembly comprises:

a first magnetic component operatively connected to the housing;

a second magnetic component operatively connected to the mobile member such that the second magnetic component moves toward and away from the first magnetic component as the mobile member pivots, wherein at least one of the first magnetic component and second magnetic component comprises the electromagnet and is configured to create a magnetic force with the other of the first and second magnetic components when supplied with electric current;

a power supply configured to transmit electric current to the electromagnet; and a bouncer control circuit configured to generate a control signal that causes the power supply to supply electric current to the electromagnet and thereby generate a magnetic force causing the mobile member to oscillate within the housing.

17. The bouncer control device of claim 16, wherein the second magnetic component comprises the electromagnet.

18. The bouncer control device of claim 16, wherein the first magnetic component comprises one or more permanent magnets.

* * * * *